US006089561A

United States Patent [19]

Marshall et al.

[11] Patent Number: 6,089,561

[45] Date of Patent: Jul. 18, 2000

[54] DOCUMENT FEEDER

[75] Inventors: Gary R. Marshall; Alexander S. Murison; Peter N. E. McLean, all of Waterloo, Canada

[73] Assignee: NCR Corporation, Dayton, Ohio

[21] Appl. No.: 09/093,701

[22] Filed: Jun. 8, 1998

[51] Int. Cl.[7] ..... B65H 5/00

[52] U.S. Cl. ..... 271/10.03; 271/111; 271/270; 271/265.02

[58] Field of Search ..... 271/10.03, 110, 271/111, 265.01, 265.02, 270

[56] References Cited

U.S. PATENT DOCUMENTS

| | | | |
|---|---|---|---|
| 3,981,493 | 9/1976 | Klappenecker et al. . | |
| 4,171,130 | 10/1979 | Jeschke et al. | 271/10.03 |
| 4,451,027 | 5/1984 | Alper | 271/270 |
| 4,541,623 | 9/1985 | Huerta . | |
| 4,548,394 | 10/1985 | Koyama et al. . | |
| 4,548,401 | 10/1985 | Nishikawa . | |
| 4,550,902 | 11/1985 | Godlewski . | |
| 4,651,983 | 3/1987 | Long | 271/110 |
| 4,790,525 | 12/1988 | Mitzel et al. | 271/111 |
| 4,893,804 | 1/1990 | Sasage et al. | 271/111 |
| 5,007,628 | 4/1991 | Skinner | 271/110 |
| 5,035,414 | 7/1991 | Shibanaka et al. . | |
| 5,129,642 | 7/1992 | Svyatsky et al. . | |
| 5,154,412 | 10/1992 | Iseda . | |
| 5,393,044 | 2/1995 | Hagihara et al. . | |
| 5,397,107 | 3/1995 | Wolog et al. . | |
| 5,443,359 | 8/1995 | Miller et al. | 271/111 |
| 5,664,771 | 9/1997 | Nagatani et al. | 271/10.03 |

FOREIGN PATENT DOCUMENTS

| | | | |
|---|---|---|---|
| 0189950 | 11/1982 | Japan | 271/110 |
| 0064933 | 3/1989 | Japan | 271/110 |
| 405105268 | 4/1993 | Japan | 271/265.01 |

*Primary Examiner*—H. Grant Skaggs
*Attorney, Agent, or Firm*—Michael Chan

[57] ABSTRACT

A document feeder is provided for feeding documents along a document feed path. The document feeder comprises a tray for containing a stack of documents to be fed along the document feed path. A picker mechanism is provided for picking a document from the stack of documents stored in the tray and moving the picked document along the document feed path. A sensor mechanism is provided for (i) detecting movement of documents along the document feed path, and (ii) providing an output signal indicative thereof. A controller responsive to the output signal from the sensor mechanism is provided for controlling operation of the picker mechanism to provide a gap of at least a predetermined size between adjacent documents moving along the document feed path.

11 Claims, 9 Drawing Sheets

DOCUMENT FEEDER

BACKGROUND OF THE INVENTION

The present invention relates to document feeding along a document feed path, and is particularly directed to a document feeder for feeding a document along a document feed path in a document processing system such as a bank check processing system.

Many different types of document feeders are known. A typical document feeder includes a document feeding mechanism which processes a stack of documents by picking documents one-by-one from top of the stack of documents. The picked documents are transported along a document feed path for further processing downstream. A disadvantage in using known document feeders is that adjacent documents being transported along the document feed path may be insufficiently spaced apart from each other. When adjacent documents being transported along the document feed path are insufficiently spaced apart from each other, the chance of a double-feed condition (i.e., two documents feeding together at the same time) occurring increases.

SUMMARY OF THE INVENTION

In accordance with one aspect of the present invention, a document feeder is provided for feeding documents along a document feed path. The document feeder comprises a tray for containing a stack of documents to be fed along the document feed path. A picker mechanism is provided for picking a document from the stack of documents stored in the tray and moving the picked document along the document feed path. A sensor mechanism is provided for (i) detecting movement of documents along the document feed path, and (ii) providing an output signal indicative thereof. A controller responsive to the output signal from the sensor mechanism is provided for controlling operation of the picker mechanism to provide a gap of at least a predetermined size between adjacent documents moving along the document feed path.

Preferably, the sensor mechanism includes a roller shaft having a longitudinal central axis and a sensor fixedly mounted on a portion of the roller shaft. The sensor roller has a longitudinal central axis which coincides with the longitudinal central axis of the roller shaft and an outer circumferential surface which engages a document in the document feed path such that the sensor roller rotates about its longitudinal central axis when the engaged document is moving downstream along the document feed path. An encoder disk is fixedly mounted on another portion of the roller shaft. The encoder disk includes an outer periphery having slits spaced apart around the outer periphery. A disk sensor cooperates with the encoder disk to provide the output signal. The output signal is indicative of rotation of the sensor roller, the encoder disk, and the roller shaft about the longitudinal central axis of the roller shaft. The controller provides a control signal which is used to control operation of the picker mechanism in response to the output signal from the disk sensor to provide the gap of at a least predetermined size between adjacent documents moving downstream along the document feed path.

In accordance with another aspect of the present invention, a method of controlling a document feeder to produce a gap of at least a predetermined size between adjacent documents moving along a document feed path comprises the steps of (a) operating a picker mechanism to pick documents from a stack of documents to be picked, (b) rotating a sensor roller when a first document is picked from the stack of documents and moved along the document feed path, (c) producing an output signal indicative of rotation of the sensor roller as the sensor roller rotates in response to the first document being moved along the document feed path, and (d) controlling operation of the picker mechanism in response to the output signal produced in step (c) such that a gap of at least a predetermined size is provided between adjacent documents moving along the document feed path.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
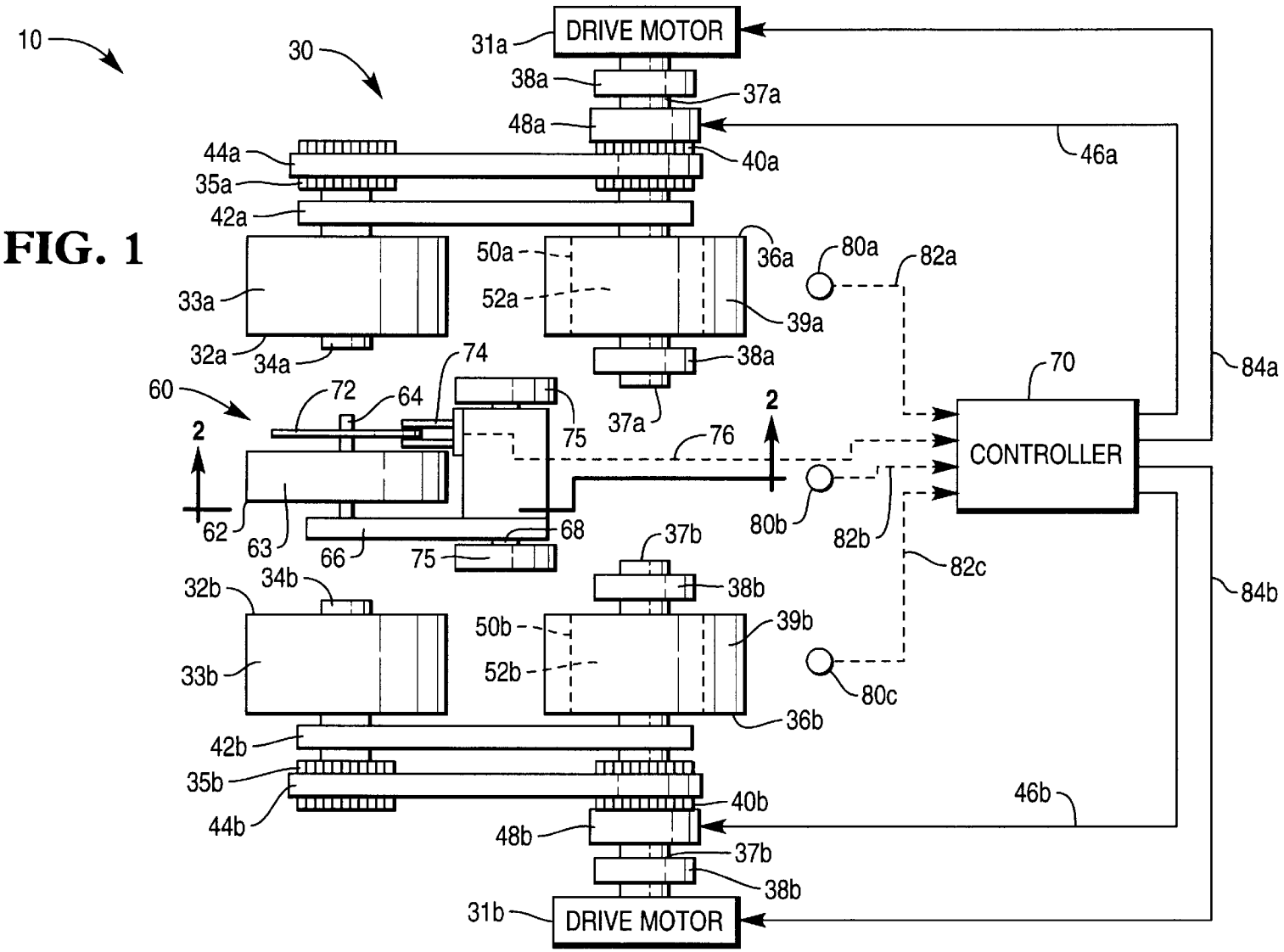
FIG. 1 is a top view with certain parts shown only schematically of a document feeder constructed in accordance with the present invention.
Figure 2:
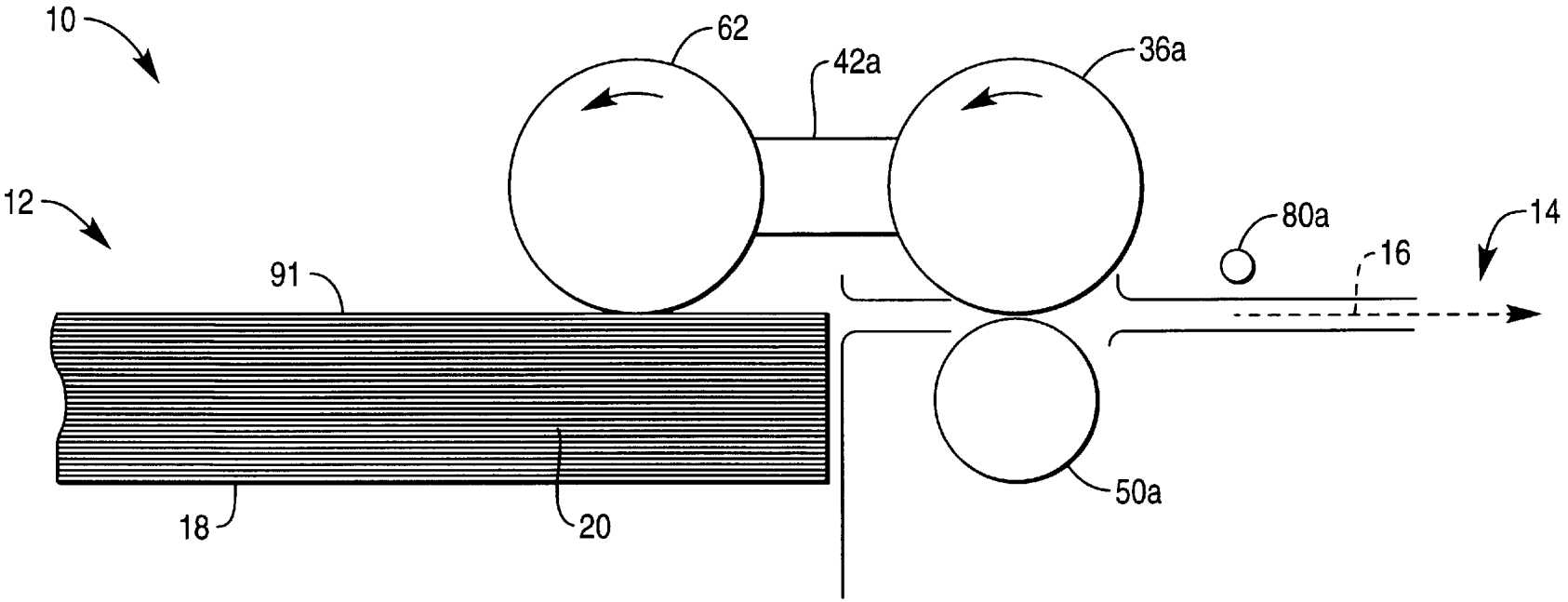
FIG. 2 is a sectional view taken approximately along line 2—2 in FIG. 1.

The present invention is directed to a document feeder which feeds documents one-by-one from a stack of documents along a document feed path of a document processing system. The specific use and construction of the present invention may vary. By way of example as shown in FIGS. 1 and 2, a document feeder constructed in accordance with the present invention is embodied in a check processing system 10.

The check processing system 10 has an upstream end 12, a downstream end 14, and a document feed path 16 defined between the upstream end 12 and the downstream end 14. A document feeder tray 18 for containing a stack 20 of documents is located along the document feeding path 16.

A picker mechanism 30 includes a pair of picker rollers 32*a*,32*b* mounted on respective shafts 34*a*,34*b*. The picker roller 32*a* is rotatable about the longitudinal central axis of the shaft 34*a*, and the picker roller 32*b* is rotatable about the longitudinal axis of the shaft 34*b*. The picker rollers 32*a*,32*b* have respective outer circumferential surfaces 33*a*,33*b* which engage the top-most document of the stack 20 of documents. A pair of toothed wheels 35*a*,35*b* are also mounted on the shafts 34*a*,34*b*, respectively. The picker roller 32*a*, the shaft 34*a*, and the toothed wheel 35*a* rotate together as a unit about the longitudinal central axis of the shaft 34*a*. Similarly, the picker roller 32*b*, the shaft 34*b*, and the toothed wheel 35*b* rotate together as a unit about the longitudinal central axis of the shaft 34*b*.

A pair of advance rollers 36*a*,36*b* are mounted on respective shafts 37*a*,37*b* which, in turn, are mounted on respective first and second pairs 38*a*,38*b* of bearings. The advance roller 36*a* is rotatable about the longitudinal central axis of the shaft 37*a* which is rotatably mounted on the first pair 38*a* of bearings. The advance roller 36*b* is rotatable about the longitudinal axis of the shaft 37*b* which is rotatably mounted on the second pair 38*b* of bearings. The advance rollers 36*a*,36*b* are located along one side of the document feed path 16 and downstream from the picker rollers 32*a*,32*b*. The advance rollers 36*a*,36*b* have respective outer circumferential surfaces 39*a*,39*b*. The advance roller 36*a* and the shaft 37*a* rotate together as a unit about the longitudinal central axis of the shaft 37*a*. Similarly, the advance roller 36*b* and the shaft 37*b* rotate together as a unit about the longitudinal central axis of the shaft 37*b*. A pair of toothed wheels 40*a*,40*b* are rotatably mounted on the shafts 34*a*,34*b*, respectively.

A first picker arm 42*a* interconnects the shaft 34*a* associated with the picker roller 32*a* and the shaft 37*a* associated with the advance roller 36*a*. The first picker arm 42*a* is pivotable about its end at the shaft 37*a* associated with the advance roller 36*a*. Similarly, a second picker arm 42*b* interconnects the shaft 34*b* associated with the picker roller 32*b* and the shaft 37*b* associated with the advance roller 36*b*. The second picker arm 42*b* is pivotable about its end at the shaft 37*b* associated with the advance roller 36*b*. A first toothed timing belt 44*a* is drivingly coupled in a known manner between the toothed wheel 35*a* associated with the picker roller 32*a* and the toothed wheel 40*a* associated with the advance roller 36*a*. Similarly, a second toothed timing belt 44*b* is drivingly coupled in a known manner between the toothed wheel 35*b* associated with the picker roller 32*b* and the toothed wheel 40*b* associated with the advance roller 36*b*.

The advance roller 36*a* is drivingly connected through the shaft 37*a* to an actuatable first drive motor 31*a*. An engageable first clutch 48*a* is coupled between the toothed wheel 40*a* and the first drive motor 31*a*. When the first clutch 48*a* is engaged and the first drive motor 31*a* is actuated, the advance roller 36*a* and the picker roller 32*a* are driven to rotate about their respective longitudinal central axes. When the first clutch 48*a* is disengaged and the first drive motor 31*a* is actuated, only the advance roller 36*a* is driven to rotate about its longitudinal central axis. When the advance roller 36*a* rotates about its longitudinal central axis in the counterclockwise direction (as viewed looking at FIG. 2), the picker roller 32*a* rotates about its longitudinal central axis also in the counterclockwise direction.

Similarly, the advance roller 36*b* is drivingly connected through the shaft 37*b* to an actuatable second drive motor 31*b*. An engageable second clutch 48*b* is coupled between the toothed wheel 40*b* and the second drive motor 31*b*. When the second clutch 48*b* is engaged and the second drive motor 31*b* is actuated, the advance roller 36*b* and the picker roller 32*b* are driven to rotate about their respective longitudinal central axes. When the second clutch 48*b* is disengaged and the second drive motor 31*b* is actuated, only the advance roller 36*b* is driven to rotate about its longitudinal central axis. When the advance roller 36*b* rotates about its longitudinal central axis in the counterclockwise direction, the picker roller 32*b* rotates about its longitudinal central axis also in the counterclockwise direction.

A pair of retard rollers 50*a*,50*b* is located along the other side of the document feed path 16 opposite the advance rollers 36*a*,36*b* and also downstream from the picker rollers 32*a*,32*b*. Accordingly, the document feed path 16 extends between the advance rollers 36*a*,36*b* and the retard rollers 50*a*,50*b*. The retard rollers 50*a*,50*b* have respective outer circumferential surfaces 52*a*,52*b*.

The advance rollers 36*a*,36*b* and the retard rollers 50*a*, 50*b* comprise an advance/retard mechanism which holds a document stationary along the document feed path 16 while allowing another document which is ahead of the document being held stationary to be advanced along the document path 16. The document being held stationary continues to be held until the document which is being advanced is moved sufficiently downstream along the document feed path 16 to separate away from the document being held stationary. The structure and operation of advance/retard mechanisms are known and, therefore, will not be described in further detail.

A sensor mechanism 60 is disposed between the picker rollers 32*a*,32*b*. The sensor mechanism 60 includes a sensor roller 62 which is mounted on a central portion of a roller shaft 64 having opposite ends and a longitudinal central axis. The sensor roller 62 has an outer circumferential surface 63. One end of the roller shaft 64 is rotatably mounted to one end of a roller arm 66 having opposite ends. An encoder disk 72 is mounted on the other end of the roller shaft 64. The encoder disk 72 includes an outer periphery having slits (not shown) equally spaced apart around the outer periphery. Accordingly, the sensor roller 62, the encoder disk 72, and the roller shaft 64 rotate together as a unit about the longitudinal central axis of the roller shaft 64 relative to the roller arm 66. The other end of the roller arm 66 is pivotably mounted on a shaft 68 which, in turn, is mounted on a pair 75 of bearings.

A disk sensor 74 is disposed between the pair 75 of bearings, as shown in FIG. 1. The disk sensor 74 provides a light beam which is directed at the outer periphery of the encoder disk 72. The disk sensor 74 also detects the presence of the light beam when the light beam passes through one of the slits spaced around the outer periphery of the encoder disk 72. Since the slits are spaced apart around the outer periphery of the encoder disk 72, the disk sensor 74 detects a light beam which appears to be pulsed when the sensor roller 62, the encoder disk 72, and the roller shaft 64 rotate together as a unit about the longitudinal central axis of the roller shaft 64. When the disk sensor 74 detects a pulsed light beam, the disk sensor 74 provides a signal on broken line 76 indicative thereof. Accordingly, when the sensor roller 62 rotates about the longitudinal central axis of the roller shaft 64, the disk sensor 74 provides a signal on broken line 76 indicative thereof. The structure and cooperation of the encoder disk 72 and the disk sensor 74 are well known and, therefore, will not be described in further detail.

A plurality of deskew sensors 80*a*,80*b*,80*c* are located downstream of the advance rollers 36*a*,36*b* and the retard rollers 50*a*,50*b*. The deskew sensors 80*a*,80*b*,80*c* are equally spaced apart along a direction transverse to the direction of movement of a document along the document feed path 16. The deskew sensors 80*a*,80*b*,80*c* provide output signals on broken lines 82*a*,82*b*,82*c*, respectively. The structure and operation of the deskew sensors 80*a*,80*b*, 80*c* are known and, therefore, will not be described. An example of deskew sensors which may be used in the present application are described in U.S. Pat. No. 5,597,155 which is assigned to NCR Corporation located in Dayton, Ohio.

A controller 70 processes the signal on line 76 from the disk sensor 74 and the signals on lines 82*a*,82*b*,82*c* from the deskew sensors 80*a*,80*b*,80*c*. The controller 70 provides control signals on lines 46*a*,46*b* in response to the signals on lines 76,82*a*,82*b*,82*c* to control the first and second clutches 48*a*,48*b*, respectively. The controller 70 also provides control signals on lines 84*a*,84*b* in response to the signals on lines 76,82*a*,82*b*,82*c* to control the first and second drive motors 31*a*,31*b*, respectively. The controller 70 controls the clutches 48*a*,48*b* and the drive motors 31*a*,31*b* in a manner to be described hereinbelow, such that a gap of at least a predetermined size is provided between adjacent documents moving downstream along the document feed path 16.

During operation, the controller 70 initially provides signals on lines 46*a*,46*b* such that the clutches 48*a*,48*b* are engaged and signals on lines 84*a*,84*b* such that the drive motors 31*a*,31*b* rotate the advance rollers 36*a*,36*b* and the picker rollers 32*a*,32*b* in the counterclockwise direction (as viewed looking at FIG. 2). Due to frictional engagement between the outer circumferential surfaces 33*a*,33*b* of the picker rollers 32*a*,32*b* and the top-most document of the stack 20, this document is picked and moved downstream along the document transport path 16 towards the right (as viewed looking at FIG. 2). This document just picked and moved downstream along the document transport path 16 is referred to hereinafter as the "first document" and designated with reference numeral "91", as shown in FIG. 2.

As the first document 91 begins to move downstream along the document feed path 16 towards the right, the sensor roller 62 begins to rotate about the longitudinal central axis of the roller shaft 64 due to frictional engagement between the outer circumferential surface 63 of the sensor roller 62 and the first document 91. As the sensor roller 62 begins to rotate, the disk sensor 74 provides a signal on line 76 indicative thereof. In response to the signal on line 76, the controller 70 provides signals on lines 46*a*,46*b* to disengage the clutches 48*a*,48*b*.

Figure 3:
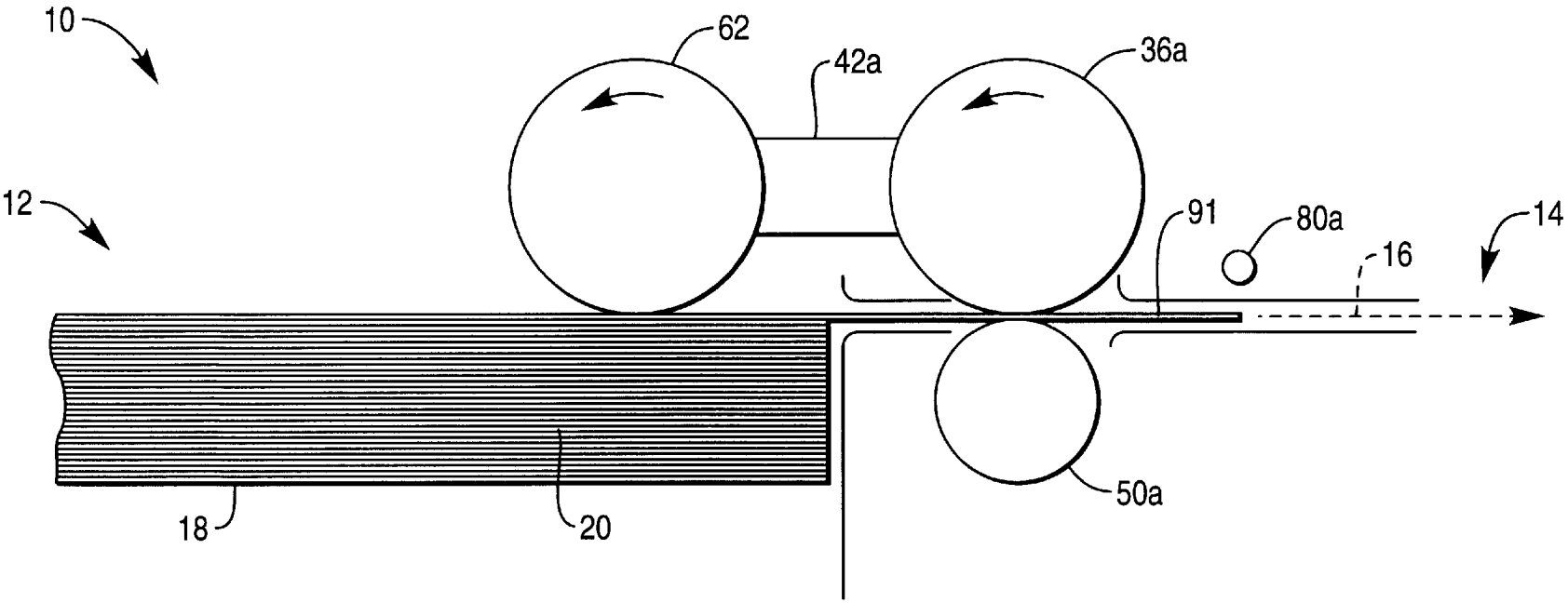
FIGS. 3–8 are views similar to FIG. 2 and showing a number of documents in different positions.

As the first document continues to move downstream along the document feed path 16, the deskew sensors 80*a*,80*b*,80*c* eventually detect the presence of the leading edge of the first document 91 as shown in FIG. 3. When this occurs, the controller 70 processes the signals on lines 82*a*,82*b*,82*c* from the deskew sensors 80*a*,80*b*,80*c* and provides control signals on lines 84*a*,84*b* to control the drive motors 31*a*,31*b*. The drive motors 31*a*,31*b* are controlled such that the advance rollers 36*a*,36*b* deskew the first document 91 in a known manner. When deskewing of the first document 91 is completed, the sensor roller 62 is halted on the first document 91 and the disk sensor 74 provides a signal on line 76 indicative thereof.

After the first document 91 is deskewed, the controller 70 controls the drive motors 31*a*,31*b* such that the advance rollers 36*a*,36*b* continue moving the first document 91 downstream along the document feed path 16. When the first document 91 begins to continue moving downstream along the document feed path 16, the sensor roller 62 begins to rotate and the disk sensor 74 provides a signal on line 76 indicative thereof. At the same time, the controller 70 receives the signal on line 76 from the disk sensor 74, but does not process this signal until after about 30 milliseconds has elapsed from the time at which the first document 91 was continued. This 30 milliseconds of delay is provided to allow the signal on line 76 from the disk sensor 74 to stabilize before processing the signal.

Figure 4:
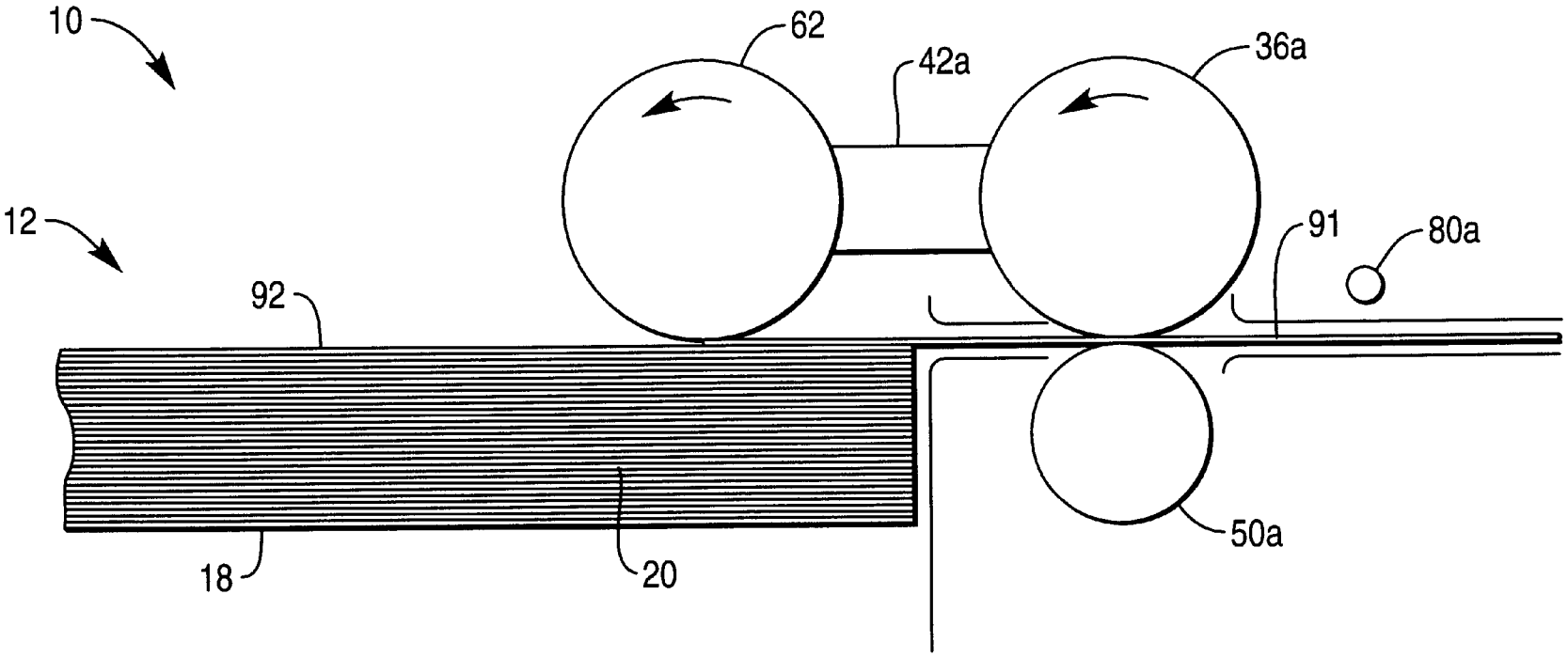

As the first document 91 continues moving downstream along the document feed path 16, the sensor roller 62 continues rotating about the longitudinal central axis of the roller shaft 64 due to frictional engagement between the outer circumferential surface 63 of the sensor roller 62 and the first document 91. Eventually, the trailing edge of the first document 91 reaches the pinch point of the sensor roller 62 as shown in FIG. 4. When this occurs, the outer circumferential surfaces 33*a*,33*b* of the picker rollers 32*a*,32*b* begin to engage the next document to be picked from top of the stack 20. This next document to be picked from top of the stack 20 is referred to hereinafter as the "second document" and is designated with reference numeral "92", as shown in FIG. 4. The outer circumferential surface 63 of the sensor roller 62 engages only the second document 92 as the first and second documents 91,92 continue moving together downstream along the document feed path 16.

Figure 5:
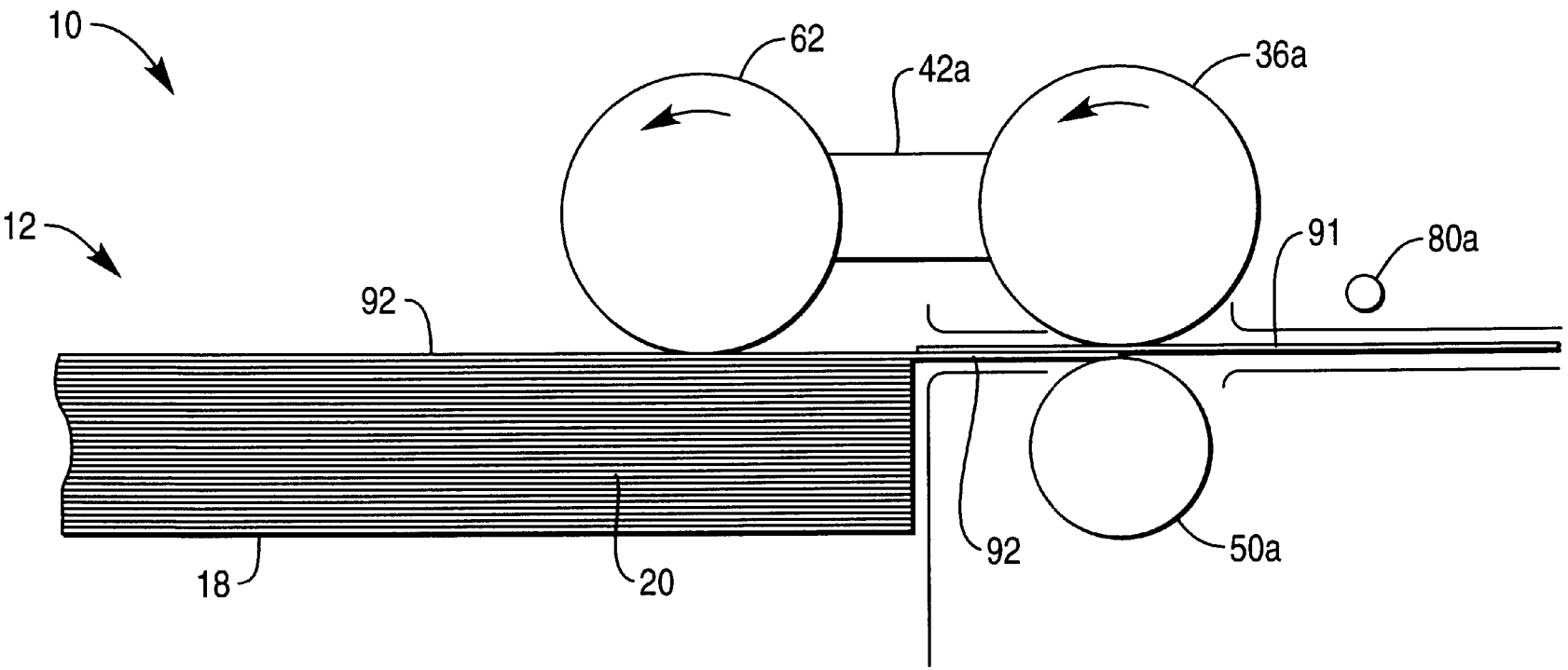

The first and second documents 91,92 continue moving together downstream along the document feed path 16 until the leading edge of the second document 92 reaches the pinch point between the advance rollers 36*a*,36*b* and the retard rollers 50*a*,50*b*, as shown in FIG. 5. When this occurs, the first document 91 continues to move downstream along the document feed path 16 and the second document 92 is halted from further movement downstream along the document feed path 16 due to cooperation between the advance rollers 36*a*,36*b* and the retard rollers 50*a*,50*b*, as is well known. Since the second document 92 is halted, the sensor roller 62 is halted and the disk sensor 74 provides a signal on line 76 indicative thereof. At this time, the trailing edge of the first document 91 is at a location somewhere between the sensor roller 62 and the advance rollers 36*a*,36*b*, as shown in FIG. 5.

Figure 6:
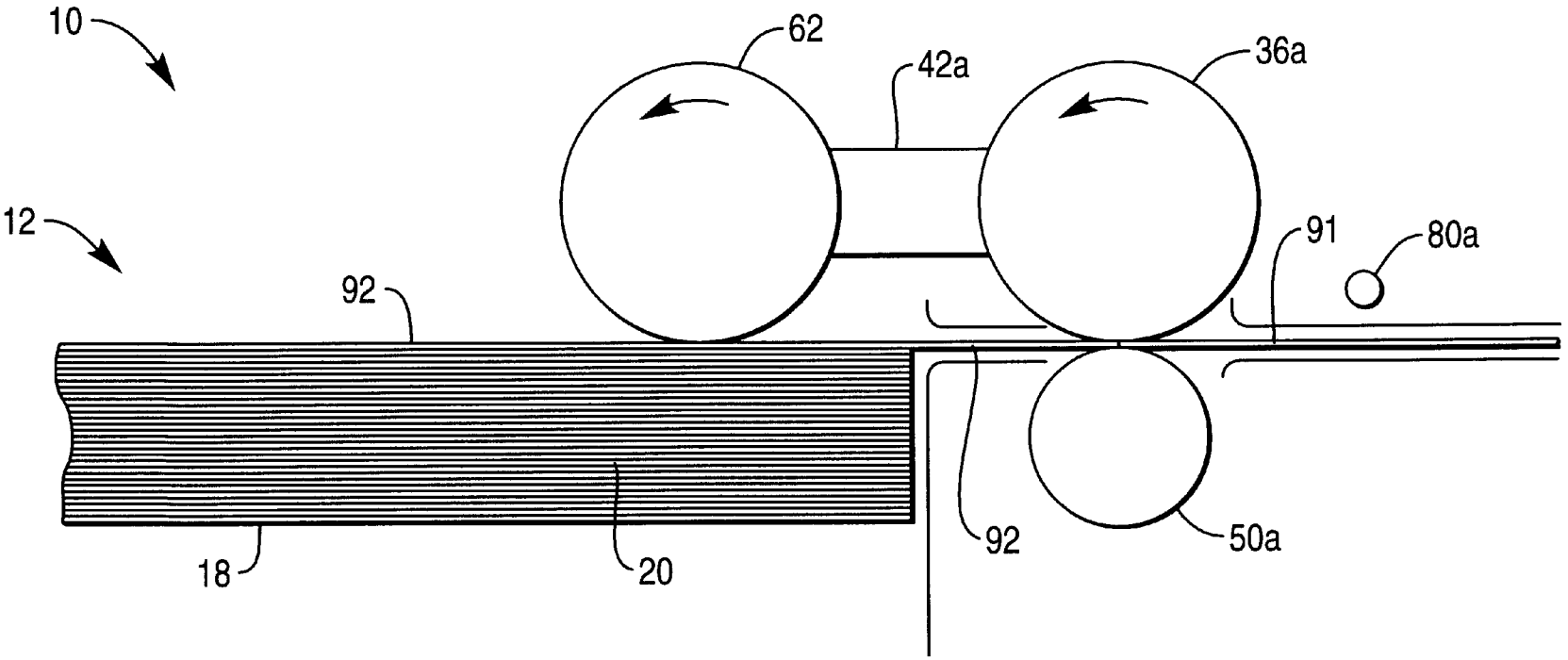

The first document 91 continues moving downstream along the document feed path 16 while the second document 92 is halted with its leading edge at the pinch point between the advance rollers 36*a*,36*b* and the retard rollers 50*a*,50*b*. As the first document 91 continues to move downstream along the document feed path 16, its trailing edge eventually reaches the pinch point between the advance rollers 36*a*,36*b* and the retard rollers 50*a*,50*b*, as shown in FIG. 6. At this time, the trailing edge of the first document 91 and the leading edge of the second document 92 are both at the pinch point between the advance rollers 36*a*,36*b* and the retard rollers 50*a*,50*b*.

When the first document 91 is in the position shown in FIG. 6, a transport mechanism (not shown) of conventional design continues to move the first document 91 downstream along the document feed path 16 in a known manner. As the trailing edge of the first document 91 begins to move away from the pinch point between the advance rollers 36*a*,36*b* and the retard rollers 50*a*,50*b*, the leading edge of the second document 92 also begins to move away from the pinch point due to frictional engagement between the outer circumferential surfaces 33*a*,33*b* of the picker rollers 32*a*,32*b* and the second document 92 and due to frictional engagement between the outer circumferential surfaces 39*a*,39*b* of the advance rollers 36*a*,36*b* and the second document 92. The leading edge of the second document 92 follows the trailing edge of the first document 91 moving downstream along the document feed path 16.

The above description assumes that the leading edge of the second document 92 has reached the pinch point between the advance rollers 36*a*,36*b* and the retard rollers 50*a*,50*b*. However, in the event that the leading edge of the second document 92 does not reach the pinch point between the advance rollers 36*a*,36*b* and the retard rollers 50*a*,50*b*, the first and second clutches 48*a*,48*b* may be engaged to continue feeding documents along the document feed path 16 until the leading edge of the second document 92 does reach the pinch point.

Figure 7:
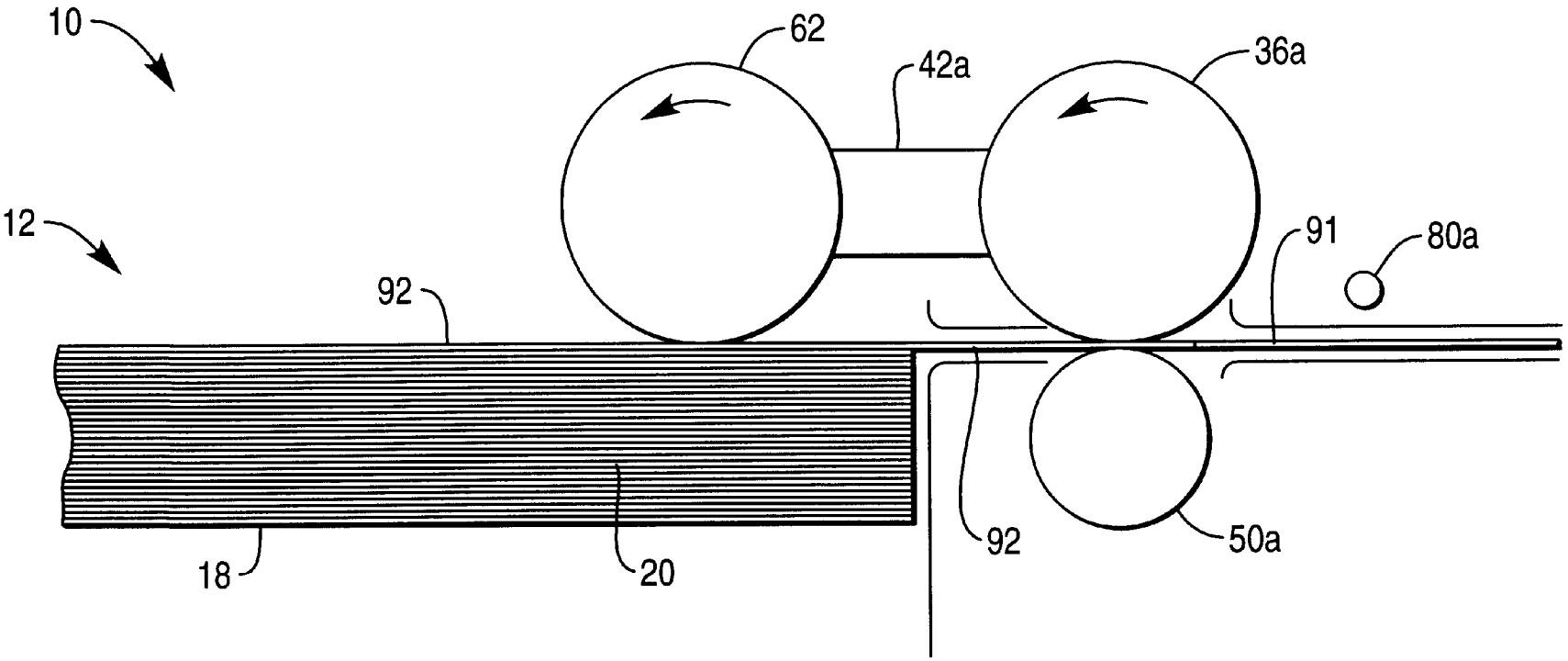

Since the second document 92 begins to move downstream along the document feed path 16, the sensor roller 62 begins to rotate about the longitudinal central axis of the roller shaft 64 and the disk sensor 74 provides a signal on line 76 indicative thereof. At the same time, the controller 70 receives the signal on line 76 from the disk sensor 74, but does not process this signal until after about 20 milliseconds has elapsed from the time at which the sensor roller 62 began to rotate. This 20 milliseconds of delay is provided to allow the signal on line 76 to stabilize before processing the signal. During this 20 millisecond delay, the leading edge of the second document 92 has moved only a slight distance downstream along the document feed path 16 from the position shown in FIG. 6 to the position shown in FIG. 7. For purposes of explanation, the distance that the leading edge of the second document 92 has moved from the position shown in FIG. 6 to the position shown in FIG. 7 is shown exaggerated.

After elapse of the 20 milliseconds just described, the controller 70 processes the signal on line 76 indicative of rotation of the sensor roller 62 about the longitudinal central axis of the roller shaft 64 and provides control signals on lines 84*a*,84*b* to halt operation of the drive motors 31*a*,31*b* and thereby to halt rotation of the advance rollers 36*a*,36*b* and the picker rollers 32*a*,32*b*. When this occurs, further movement of the second document 92 downstream along the document feed path 16 is halted. While the second document 92 is halted, the first document 91 continues to move downstream along the document feed path 16 under the drive of the transport mechanism (not shown) located downstream along the document feed path 16. Eventually, the trailing edge of the first document 91 reaches the deskew sensors 80*a*,80*b*,80*c*, as shown in FIG. 8.

Figure 8:
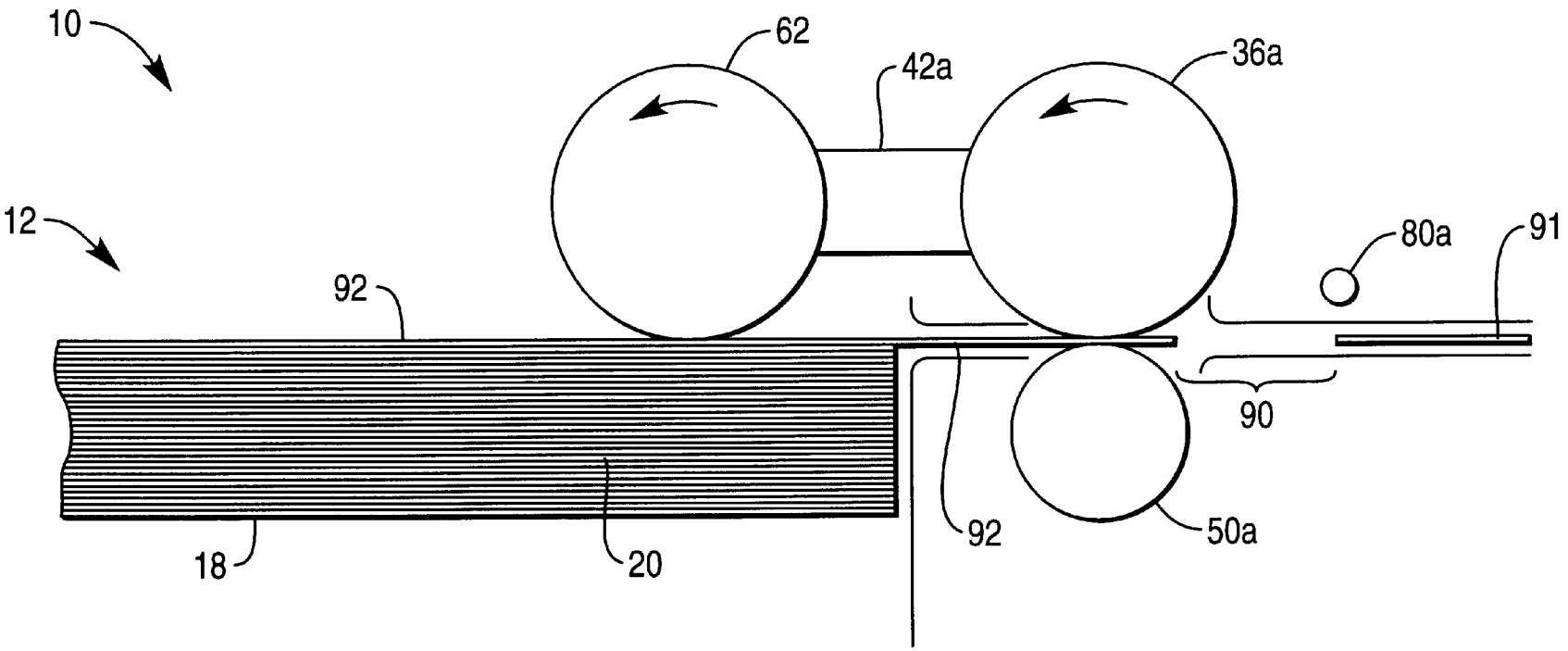

When the trailing edge of the first document 91 reaches the deskew sensors 80*a*,80*b*,80*c* shown in FIG. 8, the deskew sensors provide signals on lines 82*a*,82*b*,82*c* indicative thereof. The controller 70 processes the signals on lines 82*a*,82*b*,82*c* and provides control signals on lines 46*a*,46*b* to reengage the clutches 48*a*,48*b* and control signals on lines 84*a*,84*b* to actuate the drive motors 31*a*,31*b* again such that the advance rollers 36*a*,36*b* and the picker rollers 32*a*,32*b* continue moving the second document 92 downstream along the document feed path 16. By halting operation of the drive motors 31*a*,31*b* and thus rotation of the advance rollers 36*a*,36*b* and the picker rollers 32*a*,32*b* until the trailing edge of the first document 91 reaches the deskew sensors 80*a*, 80*b*,80*c*, a gap of at least a predetermined size is provided between the trailing edge of the first document 91 and the leading edge of the second document 92.

From this point on, the second document 92 takes the place of the first document 91 and will be processed like the first document 91 in the manner described hereinabove, and the next document to be picked from top of the stack 20 takes the place of the second document 92 and will be processed like the second document 92 in the manner described hereinabove. Accordingly, an interdocument gap is consistently provided between adjacent documents moving downstream along the document feed path 16.

Although the foregoing describes an interdocument gap which is consistently provided as a result of the trailing edge of a document reaching the deskew sensors 80*a*,80*b*,80*c*, it is conceivable that the interdocument gap may be consistently provided as a result of the trailing edge of a document reaching another type of sensor located at a different location along the document feed path 16. If this were the case, then an interdocument gap of a different predetermined size would be consistently provided between adjacent documents moving downstream along the document feed path 16. It is also conceivable that the clutches 48*a*,48*b* may not be needed. Whether or not the clutches 48*a*,48*b* are needed depends upon certain characteristics of the documents being processed, such as weight of the documents, smoothness of the documents, stiffness of the documents, and condition (e.g., creased or uncreased) of the documents.

A number of advantages result by controlling the drive motors 31*a*,31*b* to consistently provide a gap of at least a predetermined size between adjacent documents as the documents are being transported downstream along the document feed path 16. One advantage is that document misfeeds are minimized. For example, a double-feed condition (i.e., two documents being fed together at the same time) is eliminated or at least minimized. Another advantage is that the tendency of a document to skew is minimized as that document is being picked from top of the stack 20 and transported downstream along the document feeding path 16.

Figure 9:
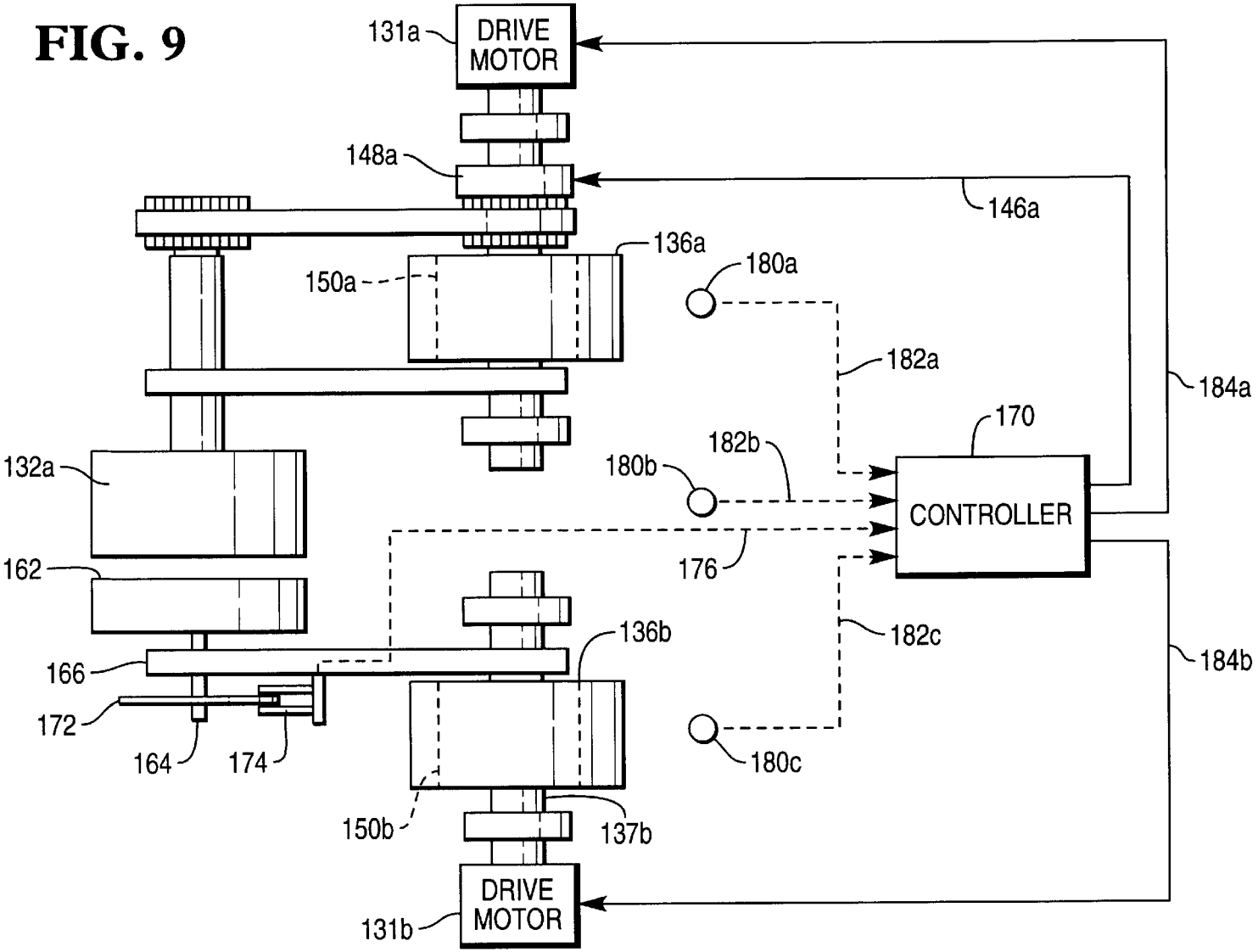
FIG. 9 is a view similar to FIG. 1 and showing another embodiment of the present invention.

A second embodiment, which is a preferred embodiment, of the present invention is illustrated in FIG. 9. Since the embodiment of the invention illustrated in FIG. 9 is generally similar to the embodiment illustrated in FIG. 1, similar numerals are utilized to designate similar components, the prefix numeral "1" being associated with the embodiment of FIG. 9 to avoid confusion. For example, the controller 170 shown in FIG. 9 corresponds to the controller 70 shown in FIG. 1.

There are three main difference between the embodiment shown in FIG. 9 and the embodiment shown in FIG. 1. The first main difference is that there is only one clutch 148*a* in the embodiment of FIG. 9, while there are two clutches 48*a*,48*b* in the embodiment of FIG. 1. The second main difference is that there is only one picker roller 132*a* in the embodiment of FIG. 9, while there are two picker rollers 32*a*,32*b* in the embodiment of FIG. 1. The third main difference is that the roller arm 166 in the embodiment of FIG. 9 is pivotably mounted on the shaft 137*b*, while the roller arm 66 in the embodiment of FIG. 1 is pivotably mounted on the shaft 68.

The advance rollers 136*a*,136*b* and the retard rollers 150*a*,150*b* co-operate to provide an advanced/retard mechanism. The sensor roller 162, the encoder disk 172, and the roller shaft 164 rotate together as a unit about the longitudinal central axis of the roller shaft 164 relative to the roller arm 166. When the sensor roller 162 rotates about the longitudinal central axis of the roller shaft 164, the disk sensor 174 provides a signal on broken line 176 indicative thereof. The controller 170 provides control signals on line 146*a* to control the clutch 148*a* and control signal on lines 184*a*,184*b* to control the drive motors 131*a*,131*b* in response to the signals on line 176 from the disk sensor 174 and the signals on lines 182*a*, 182*b*, 182*c* from the deskew sensors 180*a*, 180*b*, 180*c*, respectively, in essentially the same way as that described hereinabove with regard to the embodiment of FIG. 1.

Co-operation of the different parts shown in FIG. 9 to consistently provide an interdocument gap between adjacent documents moving downstream along a document feed path is similar to the co-operation of the different parts shown in FIG. 1. The different positions of adjacent documents moving downstream in the embodiment of FIG. 9 are the same as the different positions of adjacent documents moving downstream in the embodiment of FIG. 1. The different positions for the embodiment of FIG. 9 are the same as the different positions shown in FIGS. 2–8 for the embodiment of FIG. 1.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A document feeder for feeding documents along a document feed path, the document feeder comprising:

a tray for containing a stack of documents to be fed along the document feed path;

a picker mechanism for picking a document from the stack of documents stored in the tray and moving the picked document along the document feed path;

a first sensor for (i) detecting the trailing edge of a document moving along the document feed path, and (ii) providing a first output signal indicative of detection of the trailing edge of the document;

a second sensor for (i) engaging a document along the document feed path, (ii) detecting movement of an engaged document along the document feed path, and (iii) providing a second output signal indicative of movement of the engaged document along the document feed path; and a controller responsive to the first and second output signals from the first and second sensors for controlling operation of the picker mechanism to provide a gap of at least a predetermined size between adjacent documents moving downstream along the document feed path.

2. A document feeder according to claim 1, wherein the second sensor includes a roller shaft having a longitudinal central axis and a sensor roller fixedly mounted on a portion of the roller shaft, the sensor roller having a longitudinal central axis which coincides with the longitudinal central axis of the roller shaft and an outer circumferential surface which engages a document in the document feed path such that the sensor roller rotates about its longitudinal central axis when the engaged document is moving downstream along the document feed path.

3. A document feeder according to claim 2, wherein the second sensor includes an encoder disk fixedly mounted on another portion of the roller shaft, the encoder disk including an outer periphery having slits spaced apart around the outer periphery.

4. A document feeder according to claim 3, wherein the second sensor includes a disk sensor which cooperates with the encoder disk to provide the second output signal indicative of movement of the engaged document along the document feed path, the second output signal being indicative of rotation of the sensor roller, the encoder disk, and the roller shaft about the longitudinal central axis of the roller shaft.

5. A document feeder according to claim 4, wherein the controller provides a control signal which is used to control operation of the picker mechanism in response to the first output signal from the first sensor and the second output signal from the disk sensor to provide the gap of at least a predetermined size between adjacent documents moving downstream along the document feed path.

6. A document feeder for feeding documents along a document feed path, the document feeder comprising:

a tray for containing a stack of documents to be fed along the document feed path;

a picker mechanism for picking a document from the stack of documents stored in the tray and moving the picked document along the document feed path;

a document edge detect type sensor for (i) detecting the trailing edge of a document moving along the document feed path, and (ii) providing an edge signal indicative of detection of the trailing edge of the document;

a document movement detect type sensor for (i) engaging a document along the document feed path, (ii) detecting movement of an engaged document along the document feed path, and (iii) providing a movement signal indicative of movement of the engaged document along the document feed path; and a controller responsive to the edge signal and the movement signal from the sensors for controlling operation of the picker mechanism to provide a gap of at least a predetermined size between adjacent documents moving downstream along the document feed path.

7. A document feeder according to claim 6, wherein the document movement detect type sensor includes a roller shaft having a longitudinal central axis and a sensor roller fixedly mounted on a portion of the roller shaft, the sensor roller having a longitudinal central axis which coincides with the longitudinal central axis of the roller shaft and an outer circumferential surface which engages a document in the document feed path such that the sensor roller rotates about its longitudinal central axis when the engaged document is moving downstream along the document feed path.

8. A document feeder according to claim 1, wherein the document movement detect type sensor includes an encoder disk fixedly mounted on another portion of the roller shaft, the encoder disk including an outer periphery having slits spaced apart around the outer periphery.

9. A document feeder according to claim 8, wherein the document movement detect type sensor includes a disk sensor which cooperates with the encoder disk to provide the movement signal, the movement signal being indicative of rotation of the sensor roller, the encoder disk, and the roller shaft about the longitudinal central axis of the roller shaft.

10. A document feeder according to claim 9, wherein the controller provides a control signal which is used to control operation of the picker mechanism in response to the edge signal from the document edge detect type sensor and the movement signal from the disk sensor to provide the gap of at least a predetermined size between adjacent documents moving downstream along the document feed path.

11. A method of controlling a document feeder to produce a gap of at least a predetermined size between adjacent documents moving along a document feed path, the method comprising the steps of:

(a) operating a picker mechanism to pick documents from a stack of documents;

(b) engaging a first document to detect movement of the first document along the document feed path and providing a movement signal indicative thereof;

(c) detecting the trailing edge of the first document and providing a trailing edge signal indicative thereof; and (d) controlling operation of the picker mechanism in response to the movement signal produced in step (b) and the trailing edge signal produced in step (c) such that a gap of at least a predetermined size is provided between the trailing edge of the first document and the leading edge of a second document along the document feed path.

* * * * *